US005649620A

United States Patent [19]

Harrelson

[11] Patent Number: 5,649,620

[45] Date of Patent: Jul. 22, 1997

[54] BASKET CARRIER WITH SQUARING TABS

[75] Inventor: Glen Harrelson, Gainsville, Ga.

[73] Assignee: Riverwood International Corporation, Atlanta, Ga.

[21] Appl. No.: 570,459

[22] Filed: Dec. 11, 1995

[51] Int. Cl.[6] ..... B65D 75/00

[52] U.S. Cl. ..... 206/173; 206/172; 206/171; 206/188

[58] Field of Search ..... 206/139, 162, 206/171, 172, 173, 180, 187, 188, 191, 190

[56] References Cited

U.S. PATENT DOCUMENTS

| | | | |
|---|---|---|---|
| 2,776,072 | 1/1957 | Forrer | 206/188 |
| 3,190,487 | 6/1965 | Wood | 206/188 |
| 3,278,076 | 10/1966 | Graser | 206/173 |
| 3,349,957 | 10/1967 | Wood | 206/172 |
| 3,456,841 | 7/1969 | Mahon et al. | 206/172 |
| 3,572,545 | 3/1971 | Stout | 206/188 |
| 3,757,991 | 9/1973 | Stout | 206/187 |
| 3,917,060 | 11/1975 | Wood | 206/191 |
| 4,029,205 | 6/1977 | Wood | 206/173 |
| 5,499,712 | 3/1996 | Harrelson | 206/162 |
| 5,547,074 | 8/1996 | Plaxico et al. | 206/187 |

*Primary Examiner*—David T. Fidei

[57] ABSTRACT

A basket-style carrier designed to be automatically squared during fabrication. Squaring tabs at the lower ends of riser panels extend into slots in the end edges of the outer bottom panel flap to align the bottom panel flaps. The tabs are then folded over and glued to the outer face of the outer bottom panel flaps to strengthen the bottom panel.

3 Claims, 3 Drawing Sheets

BASKET CARRIER WITH SQUARING TABS

FIELD OF THE INVENTION

This invention relates to basket-style carriers for carrying articles such as beverage bottles. More particularly, it relates to a basket-style carrier capable of being more readily and efficiently squared up prior to forming the bottom panel.

BACKGROUND OF THE INVENTION

Basket-style carriers are commonly employed to package beverage bottles. A conventional arrangement includes a separate cell for each bottle and a center handle partition. Normally, the carriers are fabricated from a blank which is folded and glued into collapsed carrier form, after which the collapsed carrier is erected. In one design the bottom panel is integrally formed so that when the collapsed carrier is erected bottles may be inserted down onto the bottom panel through the open cells. In another design the bottom panel is formed by connecting the bottom panel forming flaps after the bottles have been inserted into the cells. The bottles are commonly inserted in this latter design by moving an opened carrier down over a group of stationary bottles, although the bottles may also be inserted by moving them down into the opened carrier.

In either case, the carrier must be squared prior to forming the bottom panel, and the subsequently formed bottom panel must be maintained in squared condition. This can be a difficult task inasmuch as the loading of an opened carrier can leave the bottom panel forming flaps in a position which, if maintained, will result in an out-of-square bottom. Even though an out-of-square bottom can be made structurally sound, the carrier does not present as attractive an appearance as a carrier which has been first squared up and the various carrier elements connected so as to maintain the squared condition.

Attempts have been made to provide bottom panel structures which overcome these problems. For example, U.S. Pat. No. 4,989,799 discloses basket-style carriers incorporating center keel tabs which extend through slots in the bottom panel flaps and are then folded back into the interior of the carrier through another slot in the outer bottom panel flap. This arrangement is intended to provide a square bottom panel by maintaining both bottom panel flaps in the desired relationship with each other and with the center handle panel. However, it requires the bottom panel flaps to be precisely aligned in order to receive the keel tabs. In addition, the tab folding operation requires relatively complicated machinery which can also slow the speed of the packaging line.

Another problem with basket-style carriers is the lack of rigidity encountered in a typical design in which the center handle panel is connected only to the end panels and is spaced from the bottom panel. Attempts have been made to strengthen such a structure by providing center keel tabs which are adhered to the bottom panel. Examples of such a design are found in U.S. Pat. Nos. 4,915,218 and 4,919,261 which disclose keel tabs that are folded and glued to the inner face of one of the bottom panel forming flaps. Such an arrangement does not assist in squaring the bottom panel, but only strengthens it after the bottom panel has been formed.

It would be highly desirable to be able to square the bottom panel of a basket-style carrier in a simple but reliable manner, while at the same time strengthening the bottom panel.

BRIEF SUMMARY OF THE INVENTION

The invention relates to basket-style carriers of the type comprised of opposite side panels connected to a bottom panel, opposite end panels connected to the side panels, a centrally located handle panel, an outer bottom panel flap foldably connected to one of the side panels and an inner bottom panel flap foldably connected to the opposite side panel. The outer bottom panel flap at least partially overlaps the inner bottom panel flap and is connected to it to form the bottom panel. In accordance with the invention, slots in the outer bottom panel flap adjacent each end panel are substantially aligned with the handle panel and receive squaring tabs connected to tab support means. The squaring tabs are folded back and are adhered to the outer face of the outer bottom panel flap.

The squaring tabs cause the bottom panel to be squared by guiding the outer bottom panel flap into place as the slots in the bottom panel flap slide over the tabs. After the outer bottom flap is adhered or otherwise connected to the inner bottom panel flap, the squaring tabs are folded over and glued to the outer bottom panel flap to further strengthen the bottom panel.

The slots are formed so that the edge over which the squaring tabs are folded is a straight edge parallel to the handle panel. The spacing between this edge and an opposite tapered edge facilitates entry of the tabs into the slots. In a preferred design, the squaring tab support means are riser panels connected to both the end panels and the handle panel.

The carrier is readily formed from a compact integral blank.

These and other features and aspects of the invention will be readily ascertained from the detailed description of the preferred embodiments described below.

DETAILED DESCRIPTION OF THE PREFERRED EMBODIMENT

Figure 1:
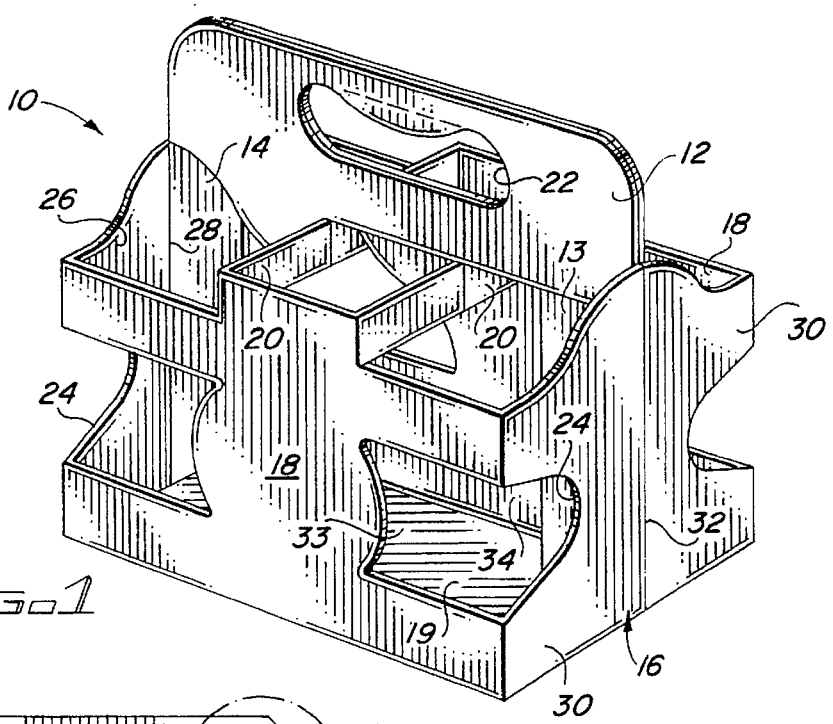
FIG. 1 is a pictorial view of a basket-style carrier incorporating the squaring features of the invention.

Referring to FIG. 1, the basket-style carrier 10 of the invention includes a central handle panel 12 connected to riser panels 13 and 14 which in turn are connected to end panels 16. The end panels are connected to side panels 18, and the side panels are connected to bottom panel 19. Individual cells for receiving bottles or other articles are formed by straps 20 which extend from the side panels 18 to the handle panel 12. The handle panel includes a handle opening 22 and the carrier further includes corner cutouts 24 which extend into the adjacent side and end panels. This construction allows substantial portions of the end bottles in the carrier to be viewed, which is advantageous where the shape of the bottles contributes to brand identification.

Each end panel 16 is formed from two end panel sections which are connected by fold lines to the adjacent riser panel 13 or 14. In the end panel facing away from the viewer, end panel sections 26 are connected to the riser panel 14 by fold lines 28. In the end panel facing the viewer, end panel sections 30 are connected to the riser panel 13 by fold lines 32. The bottom panel 19 is formed from two overlapping and interconnected flaps 33 and 34. The features of the invention which produce the desirable squaring effect and which contribute to the strength of the bottom panel are hidden in this view but are described in detail below.

Figure 2:
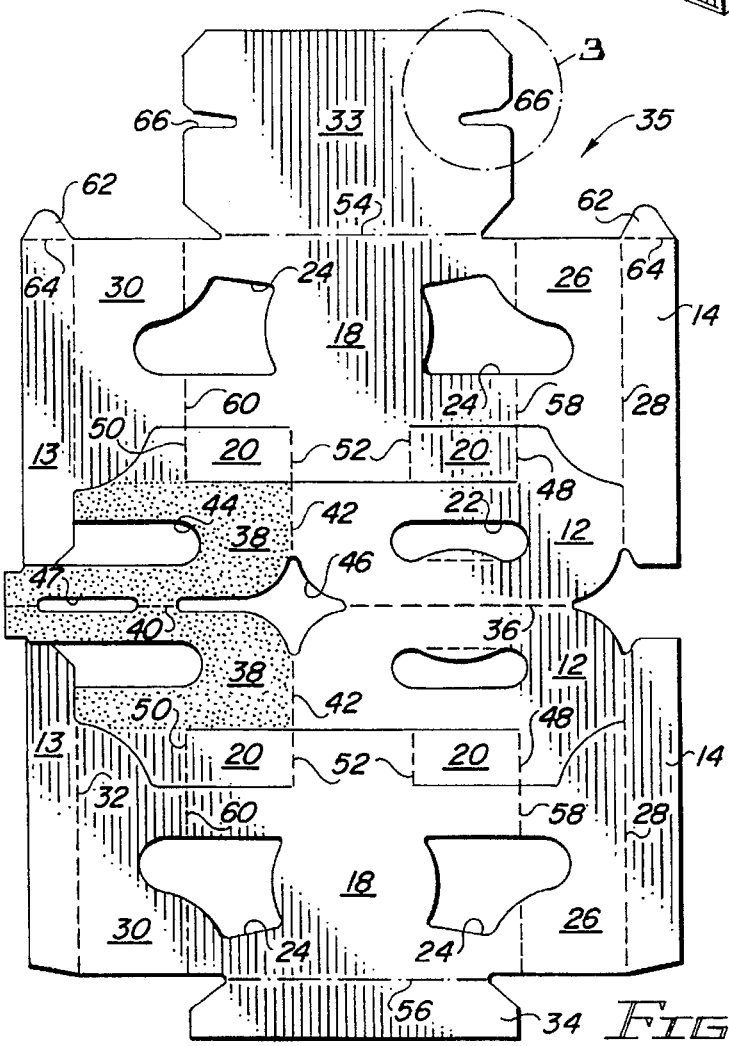
FIG. 2 is a plan view of a blank for fabricating the carrier.

Referring to FIG. 2, wherein like reference numerals to those used in FIG. 1 denote like elements, a blank 35 for forming the carrier is shown as being of generally rectangular shape except for outwardly extending bottom panel flaps. Preferably, the blank is formed from paperboard of the type conventionally used in the carrier industry. Centrally located at the right side of the blank are two similar outer handle panel sections 12 connected together by a central fold line 36. Immediately to the left of the panel sections 12 are two similar inner handle panel sections 38, which are connected to each other by central fold line 40 and are connected to the panel sections 12 by fold line 42. Cutouts 44 in the inner handle panel sections are aligned with the handle cutouts 22 in a carrier formed from the blank, and the fold line 40 is an extension of the fold line 36. Cutout 46 between the fold lines 36 and 40 facilitates folding and determines the shape of the handle panel corners. Cutout 47, which interrupts the fold line 40, also facilitates the folding process.

The outer ends of the straps 20 at the right of the blank are connected to the outer handle panel sections 12 by fold lines 48 while the outer ends of the straps at the left of the blank are connected to the inner handle panel sections 38 by fold lines 50. The inner ends of the straps are connected to the side panel sections 18 by fold lines 52. One of the side panel sections 18 is connected along fold line 54 to bottom panel flap 33, which is the outer or major flap in the bottom panel of a carrier, and the other side panel section is connected along fold line 56 to bottom panel flap 34, which is the inner or minor flap in a bottom panel. The side panel sections 18 are connected by fold lines 58 to end panel sections 26, which in turn are connected along fold lines 28 to riser panel flaps 14. Similarly, the side panel sections are connected at their opposite ends by fold lines 60 to end panel sections 30, which in turn are connected along fold lines 32 to riser panel flaps 13. Other than the edges of the handle panel sections formed by the cutout 46 and by fold lines 36, 40, 42 and 28, the edges of the handle panel sections are formed by slits separating the handle panel sections from the cell divider straps and from the side and end panel sections, producing free edges when the blank is formed into a carrier.

Figure 3:
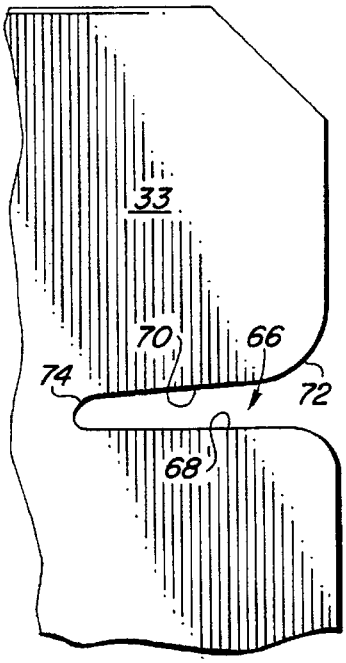
FIG. 3 is an enlarged partial plan view of the area within the circle 3 of FIG. 2.

The carrier blank described thus far is typical of one form of blank for forming a basket-style carrier whose cells are separated by straps. In accordance with the invention, bottom panel squaring tabs 62 are connected by fold lines 64 at the ends of the riser panel flaps 13 and 14 corresponding to their lower ends in a carrier formed from the blank. The squaring tabs are generally triangular in shape with a rounded apex. In addition, the outer bottom panel flap 33 includes slots 66 extending in from the side edges of the flap. As shown in greater detail in FIG. 3, each slot 66 is formed by a cutout having an edge 68 which is parallel to the fold lines 58 and 36. The opposite edge 70 forms an acute angle with the edge 68 and is rounded at its juncture with the outer edge of the flap 33 as indicated at 72. A short transverse edge 74 connects the inner ends of the slot edges 68 and 70.

It will be seen from FIG. 2 and the foregoing description that the blank is basically comprised of two identical half-blank sections differing only by the presence of the squaring tabs on one of the sections and the different size bottom panel flaps connected to each section.

Figure 4:
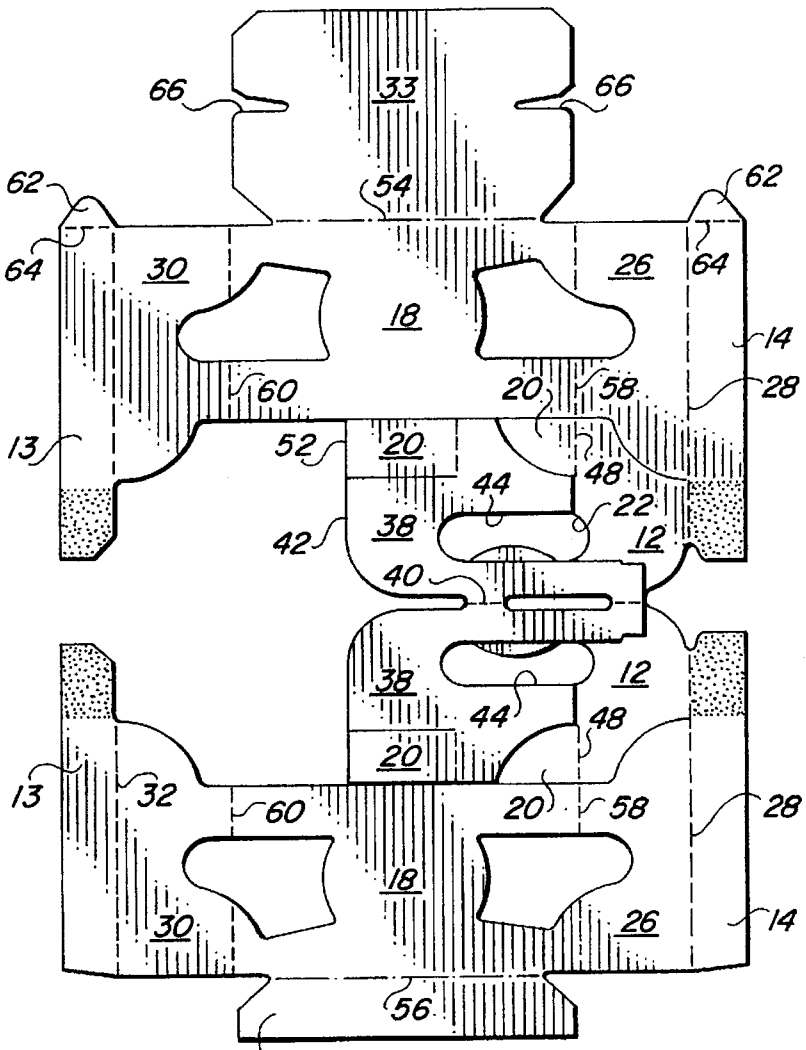
FIG. 4 is a plan view of the carrier blank after an initial folding and gluing step.

Still referring to FIG. 2, to form a carrier from the blank the inner handle panel sections 38 are coated with adhesive, as shown in stipple, and are then pivoted about fold line 42 onto the outer handle panel sections 12. This results in the interim form of blank illustrated in FIG. 4, in which the handle panel sections are adhered together. The next step is to apply adhesive to the areas of the riser panel flaps 13 and 14 shown in stipple in FIG. 4, and then to fold the end panel sections 30 about the fold lines 60. At this time the riser panel flaps 14 are also folded in about the fold lines 28. These steps adhere the riser panel flaps 13 and 14 to the handle panel sections 38 and 12 to produce the interim form of blank shown in FIG. 5.

Figure 5:
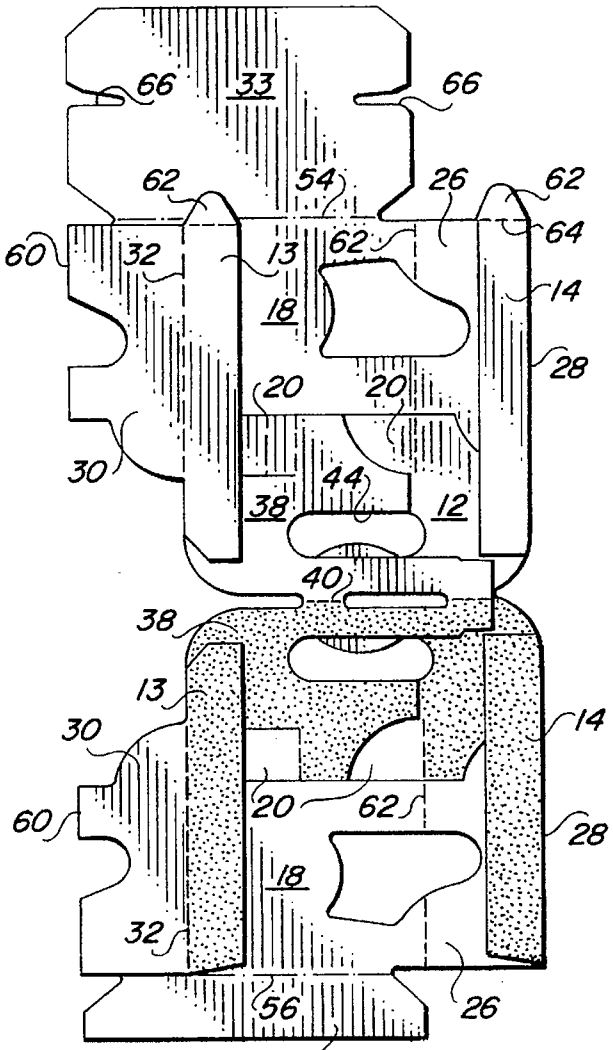
FIG. 5 is a plan view of the carrier blank after further folding and gluing steps.

The final sequence of the forming operation is to apply adhesive to the stippled areas of the folded riser panel flaps 13 and 14 and to the stippled areas of the inner and outer handle panel sections 38 and 12, as shown in FIG. 5, and to then fold the blank about the central fold lines 36 and 40. This produces the collapsed carrier illustrated in FIG. 6, in which the end panels formed from the end panel sections 26 extend out from the side panels 18 in folded condition and the end panels formed from the end panel sections 30 are inwardly folded between the side panels. The squaring tabs 62 and the bottom panel flaps are still in unfolded condition at this point.

Figure 7:
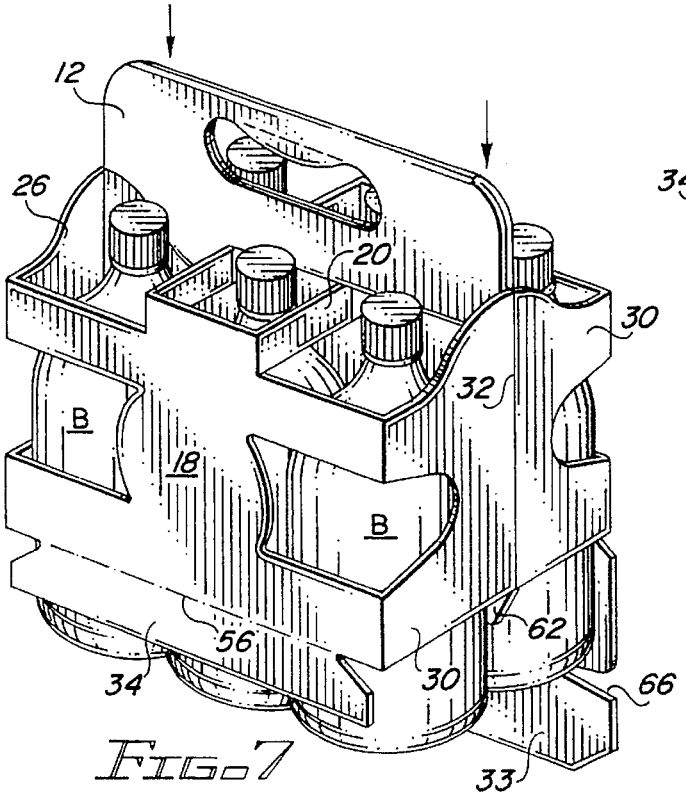
FIG. 7 is a pictorial view of an erected carrier in the process of being moved down over a group of bottles.
Figure 9:
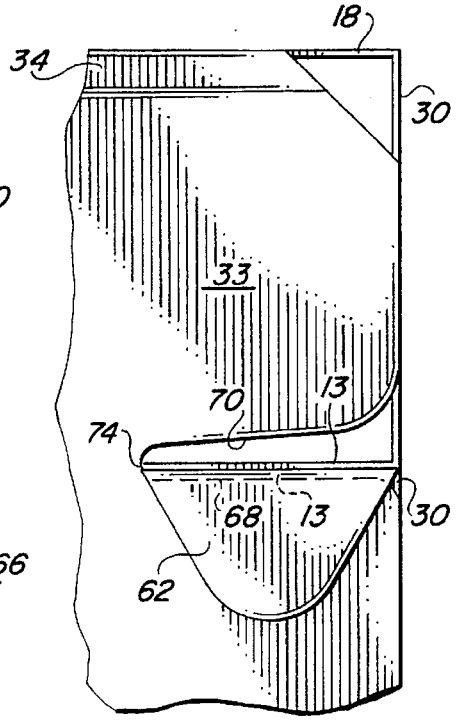
FIG. 9 is an enlarged partial plan view of the bottom panel of a carrier, showing the squaring tabs of the invention in place.
Figure 8:
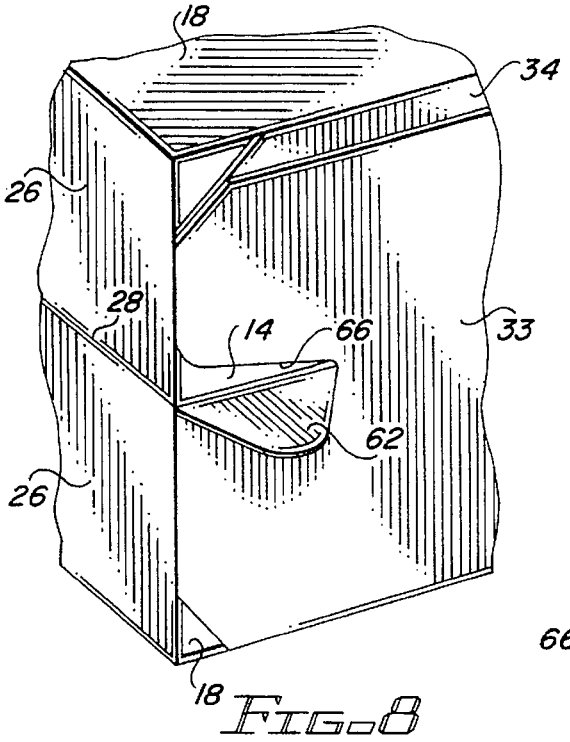
FIG. 8 is an enlarged partial pictorial view of the bottom panel of a carrier at an interim stage of fabrication.
Figure 6:
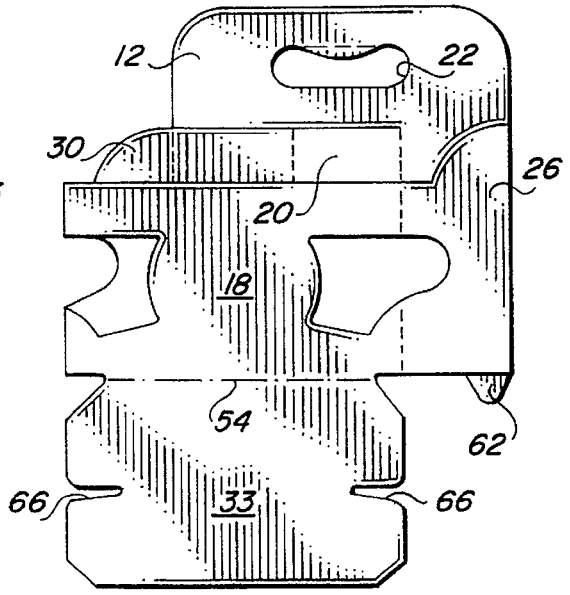
FIG. 6 is a plan view of a collapsed carrier resulting from final folding and gluing steps.

To form a loaded carrier from the collapsed carrier of FIG. 6, the collapsed carrier is squared up by pressing the outer ends of the outwardly extending end panel sections toward the opposite end, as is well known in the industry. The opened carrier is then aligned with a group of bottles B to be packaged and lowered down over them, as depicted in FIG. 7. Of course the carrier could be opened as described and bottles loaded into it by lowering them down into the carrier instead of lowering the carrier down over the bottles. During the bottle loading step the bottom panel flaps 33 and 34 and the squaring tabs 62 remain unfolded. After the carrier reaches it final position relative to the bottles, the bottom panel is formed by first folding in the inner bottom panel flap 34, then folding the outer bottom panel flap 33 to overlap the inner flap. As the outer bottom panel flap 33 moves into place the rounded corners 72 and tapered edges 70 of the slots 66 initially contact the squaring tabs 62 and, in conjunction with the transverse edges 74, guide the bottom panel flap 33 to a position engaging the straight edge 68. This procedure places the bottom panel flaps in a position which forms a square bottom panel. The bottom panel flaps and the squaring tabs are illustrated in FIG. 8 after the bottom panel flaps have been folded into place but before the squaring tabs have been folded, and are shown in FIG. 9 at their final position after being folded into place and glued to the outer bottom panel flap. This fixes the bottom panel in its squared condition and adds additional strength to the bottom panel. It further strengthens the entire carrier since the handle panel, through the riser panels and squaring tabs, are rigidly connected to the bottom panel.

It is not necessary that the squaring tabs be connected to the blank on the same side as the outer bottom panel flap. The tabs can just as well be connected on the same side as the inner bottom panel flap. In either case, however, the slots 66 in the major bottom panel flap are arranged so that their straight edges 68 are the inner edges of the slots and the tapered edges 70 are the outer edges of the slots. Although the dimensions of the squaring tabs and the slots may vary according to the design of the carrier, the length of the slots should be such that the transverse edges 74 are spaced apart a distance substantially equal to the distance between the bases of the tabs 62 at the fold lines 64. The edges 74 thus prevent the tabs 62 from moving to an out-of-square position, assuring that the bottom panel is properly formed.

Although the bottom panel flaps have been described as being attached to each other by adhesive, bottom panel flaps which are interconnected by mechanical locks could be employed instead. It will be understood, however, that even in such an arrangement the squaring tabs are glued to the outer face of the outer bottom panel flap.

It will be apparent that although the invention has been described in connection with a carrier designed for holding bottles, it applies equally to carriers designed to hold other types of articles instead. It is contemplated that the invention need not necessarily be limited to all the specific details described in connection with the preferred embodiments, but that changes to certain features of the preferred embodiment which do not alter the overall basic function and concept of the invention may be made without departing from the spirit and scope of the invention defined in the appended claims.

What is claimed is:

1. A basket-style article carrier, comprising:

opposite side panels connected to a bottom panel;

opposite end panels connected to the side panels;

a centrally located handle panel;

an outer bottom panel flap foldably connected to one of the side panels, the outer bottom panel flap having an inner face, an outer face and end edges;

an inner bottom panel flap foldably connected to the opposite side panel;

the outer bottom panel flap at least partially overlapping the inner bottom panel flap and being connected thereto to form a bottom panel;

the outer bottom panel flap including a slot adjacent each end panel, the outer end of each slot being adjacent an associated end panel and opening into an associated end edge of the outer bottom panel flap;

each slot being comprised of opposite slot edges, one of the opposite slot edges being substantially aligned with the handle panel, the opposite slot edge extending at an angle to said one slot edge so as to be more widely spaced from said one slot edge at the outer end of the slot than at the inner end;

support means for supporting a squaring tab adjacent each end panel;

the squaring tabs extending through the slots and being folded back against said one edge of each slot and adhered to the outer face of the outer bottom panel flap; and each squaring tab contacting the inner end of an associated slot substantially at the point where the squaring tab is folded against said one edge of the slot and being folded toward the foldable connection between the outer bottom panel flap and said one side panel.

2. A basket-style article carrier as defined in claim 1, wherein the opposite slot edge of each slot is connected to an associated end edge of the outer bottom panel flap by a rounded edge.

3. A basket-style article carrier as defined in claim 1, wherein the squaring tab support means comprises riser panels connected to the handle panel, the riser panels being of two-ply construction, each squaring tab being connected to one of the riser panel plies.

* * * * *